US005387147A

United States Patent [19]

Ohshima et al.

[11] Patent Number: 5,387,147

[45] Date of Patent: Feb. 7, 1995

[54] WATER-SOLUBLE BALLOON

[75] Inventors: Masatake Ohshima, Saitama; Yasuhiro Ohsone, Tokyo; Masanori Satoh, Saitama, all of Japan

[73] Assignees: Mitsui Co., Ltd., Tokyo, Japan; Mitsui Plastics, Inc., White Plains, N.Y.; Aicello Chemical Co., Ltd., Aichi, Japan

[21] Appl. No.: 63,419

[22] Filed: May 19, 1993

[30] Foreign Application Priority Data

May 20, 1992 [JP] Japan ..... 4-154355

[51] Int. Cl.[6] ..... A63H 3/06; B65D 30/02; B65D 30/00; B65D 30/24

[52] U.S. Cl. ..... 446/224; 383/1; 383/3; 383/44

[58] Field of Search ..... 446/220, 221, 222, 223, 446/224, 225, 226, 473; 206/524.7; 383/1, 3, 44

[56] References Cited

U.S. PATENT DOCUMENTS

| | | | |
|---|---|---|---|
| 3,149,017 | 9/1964 | Ehrreich | 383/3 X |
| 3,279,511 | 10/1966 | Griffin, Jr. | 383/1 |
| 3,607,817 | 9/1971 | Takigawa | 260/29.6 B |
| 3,762,454 | 10/1973 | Wilkins, Jr. | 383/1 |
| 3,892,905 | 7/1975 | Albert | 206/524.7 X |
| 4,077,588 | 3/1978 | Hurst | 446/226 X |
| 4,608,187 | 8/1986 | Chang | 206/524.7 X |
| 4,634,395 | 1/1987 | Burchett | 446/220 X |
| 4,828,554 | 5/1989 | Griffin | 604/350 |
| 4,844,828 | 7/1989 | Aoki | 206/524.7 X |
| 5,133,683 | 7/1992 | Dorfman | 206/524.7 X |
| 5,283,090 | 2/1994 | Umemura | 428/35.4 |

FOREIGN PATENT DOCUMENTS

| | | | |
|---|---|---|---|
| 2090603 | 7/1982 | United Kingdom | 206/564.7 |

OTHER PUBLICATIONS

Encyclopedia of Polymer Science & Engineering, 2nd Edition, vol. 17, John Wiley & Sons, New York, "Vinyl Alcohol Polymers", pp. 167–173.

*Primary Examiner*—Robert A. Hafer
*Assistant Examiner*—D. Neal Muir
*Attorney, Agent, or Firm*—Sughrue, Mion, Zinn, Macpeak & Seas

[57] ABSTRACT

A balloon is formed from a water-soluble film which mainly comprises a polyvinyl alcohol. Coloring agents as food additives are used for pigmenting the balloon. The balloon per se is soluble in water upon coming in contact with water and accordingly, it never becomes a cause of environmental pollution. The coloring agents used are those for use in foods and thus they do not become a cause of environmental pollution.

5 Claims, 1 Drawing Sheet

WATER-SOLUBLE BALLOON

BACKGROUND OF THE INVENTION

The present invention relates to a balloon which is sent up in the sky for the sake of display.

Balloons are sent up in the sky for the purpose of creating a spectacular atmosphere in various events and for use as media for propaganda and advertisement. Most of the conventional balloons are made of rubbers, they are in general inflated by injecting helium gas which is a gas having a low specific gravity and they are sent up and float in the sky. The helium gas leaks from the floating balloons after the lapse of a certain time period and they drop to the ground or on the surface of the sea. The dropped balloons become a cause of environmental pollution. In particular, it has been indicated that the balloons dropped on the sea drift about on the surface thereof. Marine animals such as marine turtles and sea birds may eat such floating balloons and would possibly be killed. It is not desirable to send up a large number of balloons in events while taking such a possibility of environmental pollution into consideration. However, the sending up of balloons is quite effective for creating the atmosphere of events. For this reason, there has been desired for the development of balloons made of an appropriate material which does not become a cause of environmental pollution.

SUMMARY OF THE INVENTION

Accordingly, an object of the present invention is to provide a balloon made of a material which is not accompanied by environmental pollution. The balloon according to the present invention which permits the achievement of the foregoing object is formed from a water-soluble or water-dispersible film mainly comprising polyvinyl alcohol. Therefore, the balloon of the present invention dropped to the ground or on the sea after being sent up in the sky does not remain intact since it is dissolved in the rainwater or the seawater or decomposed by the action thereof and thus a problem of environmental pollution does not arise.

Moreover, the balloon according to the present invention may comprise the foregoing water-soluble or water-dispersible film colored with a coloring agent as a food additive. For this reason, the coloring agent remaining after dissolution of the water-soluble film does not become a cause of environmental pollution.

In addition, the balloon according to the present invention may be provided with, at an opening for injecting a gas, a gas-check valve formed from a water-soluble or water-dispersible film material which mainly comprises polyvinyl alcohol.

DETAILED EXPLANATION OF THE INVENTION

Figure 1:
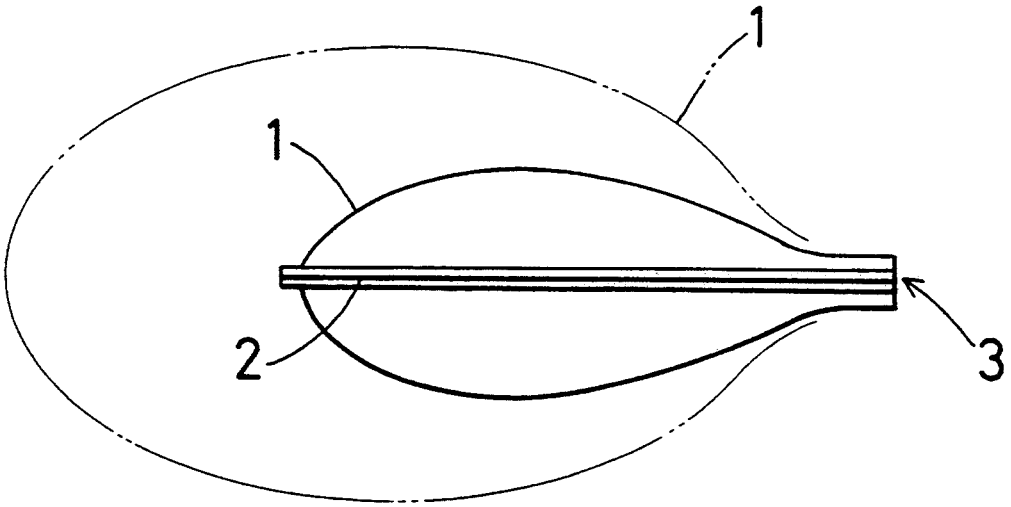
FIG. 1 is a schematic diagram illustrating the appearance of the balloon according to the present invention.

The balloon 1 according to the present invention shown in FIG. 1 is in the form of an airtightly heat-sealed bag of a film material which is formed from a mixture comprising a water-soluble or water-dispersible polyvinyl alcohol excellent in gas barrier properties and a coloring agent used as a food additive. The reference numeral 2 represents a line along which the balloon is heat-sealed and the reference numeral 3 denotes an opening for gas-injection.

Polyvinyl alcohols usable in the present invention include, for instance, partially saponified polyvinyl acetate and polyvinyl alcohols modified with, for instance, maleic acid and itaconic acid. The degree of saponification of the foregoing polyvinyl alcohols preferably ranges from 70 to 98 mole %. This is because if the degree of saponification is less than 70 mole % or exceeds 98 mole %, the water-solubility of the polyvinyl alcohols is reduced. The degree of polymerization of these polyvinyl alcohols preferably ranges from 500 to 3000. If the degree of polymerization is less than 500, the strength of the resulting polyvinyl alcohol film is low, while if it exceeds 3000, a long time period is required for the dissolution of the resulting balloon in water. The thickness of the polyvinyl alcohol film material preferably ranges from 10 to 100 μm. This is because if it is less than 10 μm, sufficient heat-seal strength cannot be ensured and the resulting balloon has insufficient gas barrier properties. Accordingly, the balloon drops to the ground or on the sea within several hours after the injection of helium gas. While if the thickness thereof exceeds 100 μm, the weight of the resulting balloon is excessively great and a large amount of helium gas must be injected in order to ensure a sufficient ascending force. Consequently, this is unfavorable from the economical standpoint.

The coloring agents as food additives usable in the present invention may be any dyestuff used as food additives which fulfill the requirements as stipulated in the Food Sanitation Act of Japan and any desired color may be imparted to the balloons by appropriately controlling the amount of the dyestuffs to be added and by the use of a mixture of at least two dyestuffs for foods.

The polyvinyl alcohol may optionally comprise other additives such as other resins, plasticizers, slip agents and/or surfactants. Moreover, any character and picture can be printed on the surface of the balloon in order to increase the demonstration effect of the balloon.

The balloons according to the present invention can be prepared from a polyvinyl alcohol film material by putting two sheets of the film material in layers and then heat-sealing the sheets through pressing, against the sheets, a ring-like mold of brass having a shape in accord with that of the balloon 1, which is heated to a predetermined temperature. Then the sheets are punched out at the periphery of the balloon along the heat-sealed portion using a cutter having a shape identical to that of the brass mold.

Helium gas is injected into the balloon 1 thus formed through the opening 3 for gas-injection. The chain line in FIG. 1 shows the external shape of the balloon 1 filled with the injected helium gas. The balloon 1 can float in the air by securely tying it at the portion of the gas-injection opening 3.

Incidentally, the balloon 1 may be integrally molded into a seamless shape through the blow molding technique.

Figure 2:
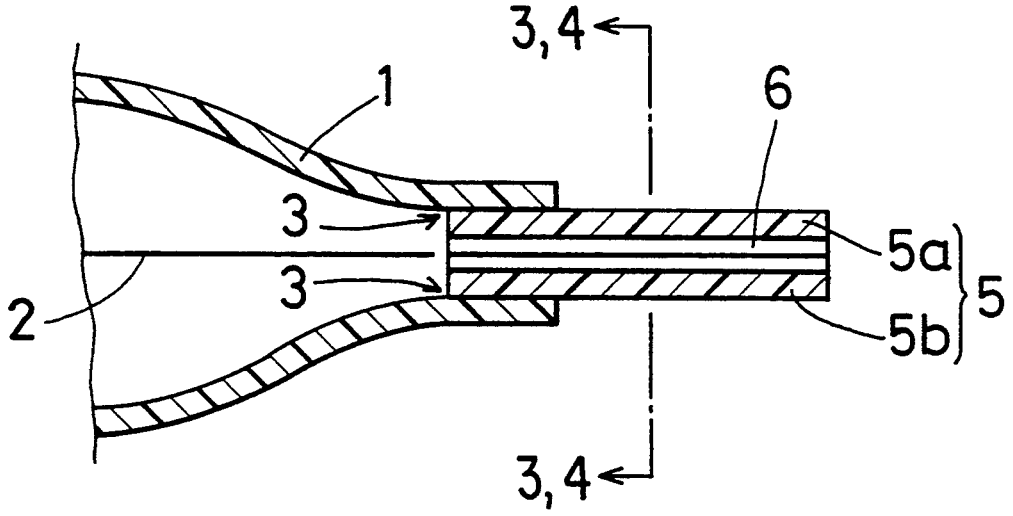
FIG. 2 is a cross sectional view showing the portion in the proximity of a gas-check valve of the balloon according to the present invention.
Figure 3:
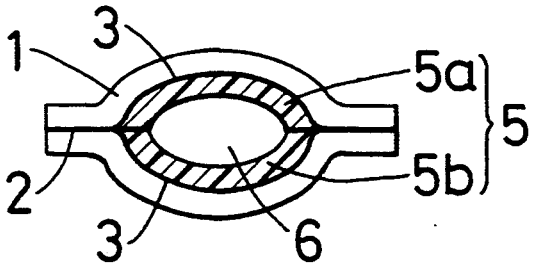
FIG. 3 is a cross sectional view of the balloon taken along the line 3, 4—3, 4 in FIG. 2.

According to the embodiment shown in FIG. 2, the balloon 1 is provided with a gas-check valve 5 for preventing any leakage of the gas at the gas-injection opening 3. The gas-check valve 5 is formed from a water-soluble or water-dispersible film material like the balloon 1. As shown in FIGS. 2 and 3, the gas-check valve 5 is formed by heat-sealing both edges of two strip type films 5*a* and 5*b* put in layers and is provided with a cylindrical opening 6. The outer surface of one end of the check valve 5 comprising these films 5*a* and 5*b* is adhered to the inner wall of the gas-injection opening 3 of the balloon 1.

Figure 4:
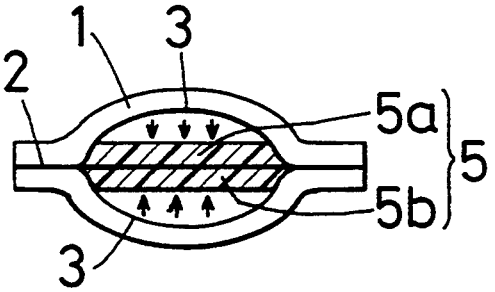
FIG. 4 is a cross sectional view of the balloon, after injecting a gas thereinto, taken along the line 3, 4—3, 4 in FIG. 2.

According to this embodiment of the balloon 1, a predetermined amount of helium gas is injected into the balloon 1 through the opening 6 and then the films 5*a* and 5*b* are lightly pinched with fingers to collapse the opening 6 and to thus close or seal the balloon 1 as shown in FIG. 4. In this respect, any helium gas does not flow backward and leak even if the hands and fingers are removed from the films. If the helium gas flows backward and runs out from the balloon, the pressure in the direction perpendicular to that of the gas flow is lower than the atmospheric pressure because of the flow velocity of the leaked gas and accordingly, the films 5*a* and 5*b* are adhered to one another through the action of the atmospheric pressure, as indicated by an arrow in FIG. 4, to thus airtightly close the opening 6 and to correspondingly prevent any ejection of the gas.

The present invention will hereinafter be explained in more detail with reference to the following Examples, but the present invention is by no means limited to these specific Examples.

EXAMPLE 1

Balloons having diameters of 40 cm and 5 cm respectively were prepared from two polyvinyl alcohol films, put in layers, having thicknesses of 25 μm (SOLUBLON KA-25, available from AICELLO Chemical Co., Ltd.), which were pigmented with 0.1 part by weight of an edible dyestuff: Red No. 102 per 100 parts by weight of the polyvinyl alcohol using a heat-sealer. Check valves were prepared from the material identical to that used for preparing the balloons (KA-25) and adhered to the opening of the balloons using a heat-sealer. Helium gas was injected into the balloon having a diameter of 40 cm and the inflated balloon was subjected to a floating test and it was found that the inflated balloon did not drop even after one week. Separately, the balloon having a diameter of 5 cm was floated on the surface of the seawater contained in a 10 liter container and it was found that the balloon completely dissolved therein and disappeared within 3 minutes.

EXAMPLE 2

The same procedures used in Example 1 were repeated except for using modified polyvinyl alcohol films (SOLUBLON PH-60, available from AICELLO Chemical Co., Ltd.) having a thickness of 60 μm, each of which was pigmented with 1 part by weight of silicon dioxide per 100 parts by weight of the polyvinyl alcohol to give balloons having diameters of 50 cm and 5 cm respectively. Check valves were likewise prepared from non-pigmented KA-25 and fitted to the resulting balloons. In a floating test, the balloons were floated in the air even after one week. In a test for dissolving them in seawater, they were dissolved in the seawater and disappeared within 3 minutes.

EXAMPLE 3

The same procedures used in Example 1 were repeated except for using non-pigmented polyvinyl alcohol films (SOLUBLON KL-40, available from AICELLO Chemical Co., Ltd.) each having a thickness of 40 μm to give balloons having diameters of 50 cm and 5 cm respectively. Any check valve was not fitted to these balloons. After injecting helium gas into the balloons, the openings thereof were heat-sealed using a heat-sealer. These balloons were subjected to a floating test. The results indicates that the balloons were floated in the air even after one week. In a test for dissolving them in seawater, they were dissolved in the seawater and disappeared within 3 minutes.

COMPARATIVE EXAMPLE 1

A balloon made of a natural rubber having a diameter of 30 cm and a thickness of 25 μm was subjected to a floating test, but it dropped to the ground after two days. Moreover, it was not dissolved in the seawater at all and remained intact and never disappeared even after one month.

COMPARATIVE EXAMPLE 2

The same tests performed in Comparative Example 1 were carried out except for using a balloon made of a natural rubber having a diameter of 50 cm and a thickness of 40 μm and as a result, it was found that it dropped to the ground after two days as observed in Comparative Example 1 and that it was not dissolved in the seawater at all and remained as it had been floated on the seawater even after one month.

What is claimed is:

1. A water-soluble balloon including a sealable inflation neck adapted to retain gas under pressure within confines of said balloon, formed from a water-soluble expandable elastic film material which consists essentially of a polyvinyl alcohol having a degree of saponification ranging from 70 to 98 mol %, and a degree of polymerization ranging from 500 to 3,000, thereby resulting in a balloon that will disintegrate upon contact with liquid water.

2. The water-soluble balloon of claim 1 wherein the water-soluble or water-dispersible film is pigmented with a coloring agent of a food additive.

3. The water-soluble balloon of claim 1 wherein the balloon is provided with, at an opening for injecting a gas, a gas-check valve formed from a water-soluble or water-dispersible film material which mainly comprises a polyvinyl alcohol.

4. A water-soluble balloon of claim 1 wherein the thickness of a polyvinyl alcohol film material is from 10 to 100 μm.

5. A water-soluble balloon of claim 1 wherein the polyvinyl alcohol film material further comprises a plasticizer.

* * * * *